US009028038B2

(12) United States Patent
Nagaoka et al.

(10) Patent No.: US 9,028,038 B2
(45) Date of Patent: May 12, 2015

(54) LIQUID DISCHARGE HEAD

(71) Applicant: Canon Kabushiki Kaisha, Tokyo (JP)

(72) Inventors: Kyosuke Nagaoka, Kodaira (JP); Masako Shimomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/507,611

(22) Filed: Oct. 6, 2014

(65) Prior Publication Data

US 2015/0097892 A1 Apr. 9, 2015

(51) Int. Cl.
*B41J 2/16* (2006.01)
*B41J 2/14* (2006.01)

(52) U.S. Cl.
CPC ..... *B41J 2/14* (2013.01)

(58) Field of Classification Search
CPC ..... B41J 2002/14475; B41J 2/1603; B41J 2/1629; B41J 2/1631; B41J 2/1635; B41J 2/1642; B41J 2/1645
USPC ..... 347/20, 40, 63, 71
See application file for complete search history.

(56) References Cited

U.S. PATENT DOCUMENTS 7,862,158 B2 * 1/2011 Fujii et al. ..... 347/63
2014/0151733 A1 * 6/2014 Koike et al. ..... 257/98

FOREIGN PATENT DOCUMENTS

JP 11-348290 A 12/1999

* cited by examiner

*Primary Examiner* — Thinh Nguyen
(74) *Attorney, Agent, or Firm* — Canon U.S.A. Inc., IP Division

(57) ABSTRACT

A liquid discharge head has a substrate having an inorganic material layer, an organic material layer, and an intermediate layer contacting the inorganic material layer and the organic material layer between the inorganic material layer and the organic material layer, in which the intermediate layer contains a resin having three or more cyclohexene oxide skeletons in the molecules, a photocationic polymerization initiator, a thermal cationic polymerization initiator, and an onium salt containing a cation portion structure represented by (d1) and an anion portion structure represented by (d2).

16 Claims, 3 Drawing Sheets

LIQUID DISCHARGE HEAD

BACKGROUND OF THE INVENTION

1. Field of the Invention

The present invention relates to a liquid discharge head.

2. Description of the Related Art

The liquid discharge head is used for a liquid discharge apparatus, such as an ink jet recording apparatus, and has a channel forming member and a substrate. The channel forming member is provided on the substrate and forms a liquid channel and, according to circumstances, forms a liquid discharge port. The substrate has a liquid supply port formed thereon and has energy-generating elements on the front surface side. Liquid is supplied to the channel from the liquid supply port, receives energy from energy-generating elements, and then is discharged from the liquid discharge port to be applied onto a recording medium, such as paper.

On the substrate, an insulation layer and a protective layer covering the energy-generating elements are provided or an inorganic material layer is provided for other various purposes in many cases.

On the other hand, it is known to form the channel forming member and the other structures on the substrate with an organic material layer. In particular, when the organic material layer is formed with a photosensitive resin, high-accuracy formation can be achieved by photolithography.

However, the adhesion strength between the inorganic material layer and the organic material layer on the substrate tend to be low. For example, when the organic material layer is directly disposed on the inorganic material layer, peeling occurs between both the layers in some cases. In order to solve such a problem, Japanese Patent Laid-Open No. 11-348290 describes a method for suppressing peeling between an inorganic material layer and an organic material layer by providing an intermediate layer formed with a polyetheramide resin between the inorganic material layer and the organic material layer.

SUMMARY OF THE INVENTION

The present invention is a liquid discharge head having a substrate having an inorganic material layer, an organic material layer, and an intermediate layer contacting an inorganic material layer and an organic material layer between the inorganic material layer and the organic material layer, in which the intermediate layer contains a resin having three or more cyclohexene oxide skeletons in the molecules, a photocationic polymerization initiator, a thermal cationic polymerization initiator, and an onium salt containing a cation portion structure represented by (d1) shown below and an anion portion structure represented by (d2) shown below.

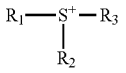

(d1)

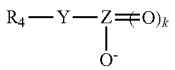

(d2)

[In the cation portion structure represented by (d1), $R_1$ to $R_3$ independently represent an organic group having 1 to 15 carbon atoms which may have a substituent. In the anion portion structure represented by (d2), Z represents a carbon atom or a sulfur atom, and when Z is a carbon atom, k=1 is established and when Z is a sulfur atom, k=2 is established. Y represents any one of —S(=O)$_2$—, an alkylene fluoride group having 1 to 15 carbon atoms, —O—CF$_2$—, —C(=O)—CF$_2$—, —O—C(=O)—CF$_2$—, —C(=O)—O—CF$_2$—, and a single bond. $R_4$ represents a hydrocarbon group having 1 to 20 carbon atoms which may contain a hetero atom.]

Further features of the present invention will become apparent from the following description of exemplary embodiments with reference to the attached drawings.

DESCRIPTION OF THE EMBODIMENTS

According to an examination of the present inventors, even when the intermediate layer formed with a polyetheramide resin described in Japanese Patent Laid-Open No. 11-348290 is disposed, peeling between the inorganic material layer and the organic material layer has occurred in some cases. For example, when an ink in which particularly the solvent ratio is high has been used as liquid to be made to pass through a channel, peeling has occurred between the intermediate layer and the organic material layer, which has consequently led to peeling between the inorganic material layer and the organic material layer in some cases. As a result of further advancing the examination, it has been found that the intermediate layer formed with a polyetheramide resin has deteriorated due to the ink described above, and the adhesion strength between the intermediate layer and the organic material layer has decreased.

The manufacture of the liquid discharge head tends to require more detailed processing, and the intermediate layer itself is required to be able to be subjected to high-accuracy patterning with high resolution.

Examples of a material which is hard to deteriorate due to an ink with a high solvent ratio and also has high resolving power include a bisphenol A epoxy resin, a novolac epoxy resin, an epoxy resin having an oxycyclohexene skeleton, and the like but the resins have low adhesion strength with the inorganic material layer. Therefore, when the resins are formed into the intermediate layer, peeling occurs between the intermediate layer and the inorganic material layer under a liquid (ink) immersion environment in some cases. Moreover, these epoxy resins have high mechanical strength. Thus, when the epoxy resins are used as the intermediate layer, it has also been difficult to suppress peeling due to a linear expansion coefficient difference between the inorganic material layer and the organic material layer. The peeling due to a linear expansion coefficient difference is likely to occur particularly when the head is formed to have a long length or when the thickness of the organic material layer is large.

Therefore, the present invention provides a liquid discharge head having an intermediate layer which is difficult to peel between an organic material layer and a inorganic material layer and has high resolving power.

Hereinafter, embodiments for carrying out the present invention are described.

Liquid Discharge Head

Figure 1A:
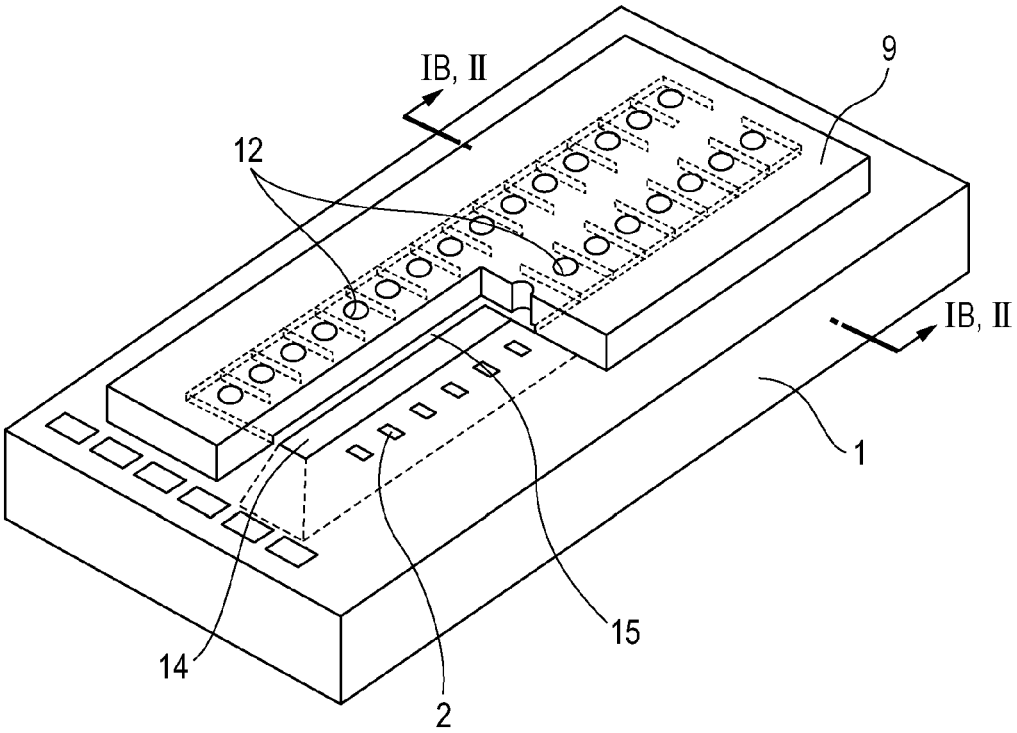
FIGS. 1A and 1B are views illustrating one example of a liquid discharge head of the present invention.
Figure 1B:
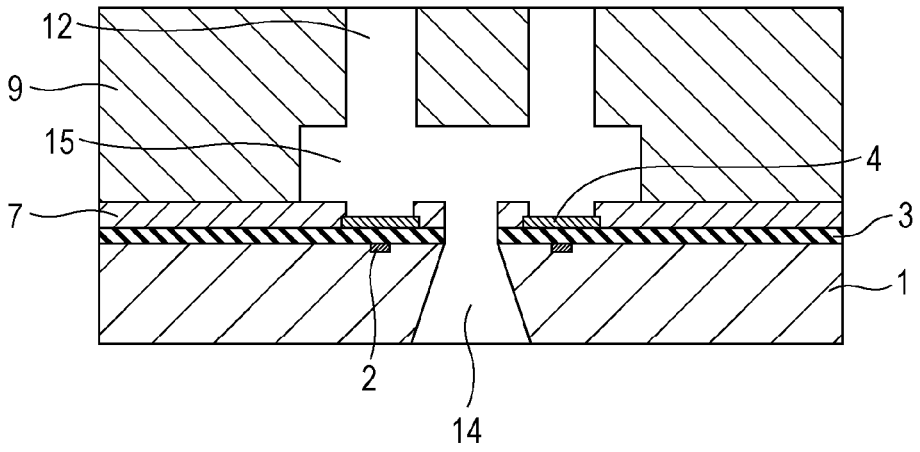

First, the structure of the liquid discharge head of the present invention is described with reference to FIGS. 1A and 1B. FIG. 1A is a view illustrating one example of the liquid discharge head of the present invention. FIG. 1B is a cross sectional view in a surface perpendicular to the front surface of a substrate taken along IB-IB of FIG. 1A.

The liquid discharge head illustrated in FIGS. 1A and 1B has a substrate 1 on which energy-generating elements 2 which generate energy for discharging liquid are formed at a predetermined pitch. The substrate 1 is formed with silicon, for example. Examples of the energy-generating elements 2 include an electrothermal conversion element and a piezoelectric element. The energy-generating elements 2 may be provided in such a manner as to contact the front surface of the substrate 1 or may be provided to be partially hollow with respect to the front surface of the substrate 1. To the energy-generating elements 2, a control signal input electrode (not illustrated) for causing the energy-generating elements 2 to operate is connected.

On the front surface side of the substrate 1, an inorganic material layer 3 and a protective layer 4 are formed. Examples of the substrate 1 include a silicon substrate formed with silicon. The silicon substrate desirably contains a silicon single crystal and the crystal orientation of the front surface is desirably (100). Examples of the inorganic material layer 3 include silicon oxide ($SiO_2$), silicon nitride (SiN), silicon carbide (SiC), silicon carbonitride (SiCN), and the like. In FIGS. 1A and 1B, the inorganic material layer 3 is used as a heat storage layer or an insulation layer. The protective layer 4 protects the energy-generating elements, and is formed with Ta, for example. The inorganic material layer 3 may cover the energy-generating elements.

In FIGS. 1A and 1B, the inorganic material layer 3 is formed on almost the entire front surface of the substrate 1. On the upper portion of the inorganic material layer 3, an intermediate layer 7 is formed. On the upper portion of the intermediate layer 7, an organic material layer 9 is formed. The upper portion is a side where discharge ports are provided with respect to the front surface of the substrate. The intermediate layer 7 is positioned between the inorganic material layer 3 and the organic material layer 9 and contacts the inorganic material layer 3 and the organic material layer 9. The intermediate layer 7 increases the adhesion strength between the inorganic material layer 3 and the organic material layer 9. In FIGS. 1A and 1B, the organic material layer 9 is a channel forming member which forms a channel 15 and discharge ports 12 for liquid. The substrate 1 is provided with a supply port 14. Liquid supplied to the channel 15 from the supply port 14 receives energy from the energy-generating elements 2, and then is discharged from the discharge ports 12.

Method for Manufacturing Liquid Discharge Head

Next, a method for manufacturing a liquid discharge head of the present invention is described with reference to FIGS. 2A to 2J. FIGS. 2A to 2J are cross sectional views of the liquid discharge head in the same portion as that of FIG. 1B.

Figure 2A:
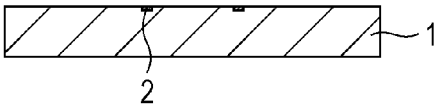
FIGS. 2A to 2J are views illustrating one example of a method for manufacturing a liquid discharge head of the present invention.

First, as illustrated in FIG. 2A, the substrate 1 having the energy-generating elements 2 on the front surface side is prepared.

Figure 2B:
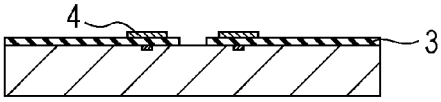

Next, as illustrated in FIG. 2B, the inorganic material layer 3 is formed on the front surface side of the substrate 1 in such a manner as to cover the energy-generating elements 2. Moreover, the protective layer 4 is formed on the upper portion of the energy-generating elements 2. The inorganic material layer 3 and the protective layer 4 are patterned as required.

Figure 2C:
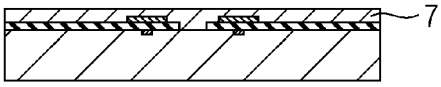

Next, as illustrated in FIG. 2C, the intermediate layer 7 is formed on the upper portion of the inorganic material layer 3 in such a manner as to contact the inorganic material layer 3. The intermediate layer 7 is formed by, for example, application by spin coating. The thickness of the intermediate layer 7 is preferably 1 μm or more and 20 μm or less.

Figure 2D:
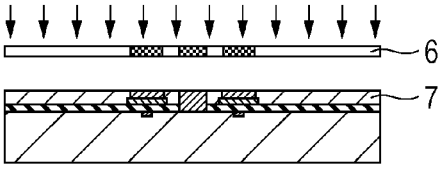

Next, as illustrated in FIG. 2D, exposure of the intermediate layer 7 is performed. The exposure of the intermediate layer 7 is performed using a mask 6 with an i-line exposure stepper, for example. Subsequently, the intermediate layer 7 is heat-treated at a temperature equal to or higher than the softening point of the intermediate layer 7. Such heat treatment is referred to as a PEB (Post Exposure Bake) process. When the intermediate layer 7 is a negative photosensitive resin, a portion which is subjected to the exposure of the intermediate layers 7 is cured. The mask 6 is one in which a light shielding film, such as a chromium film, is formed according to the pattern on a substrate containing glass, quartz, or the like which penetrates light of the exposure wavelength in such a manner as not to expose a portion which is not to be subjected to the exposure, e.g., the intermediate layer 7 on the energy-generating elements 2.

Figure 2E:
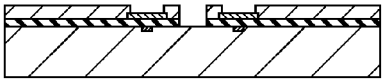

Next, as illustrated in FIG. 2E, the intermediate layer 7 is patterned by developing a non-exposed portion of the intermediate layer 7 with a developing solution. Examples of the developing solution include methyl isobutyl ketone (MIBK), xylene, and the like. Moreover, rinse treatment with isopropyl alcohol (IPA) and the like and post bake may be performed as required.

Figure 2F:
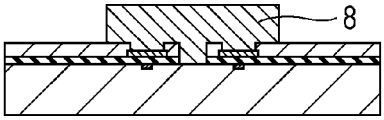

Next, as illustrated in FIG. 2F, a mold material 8 is formed on the front surface side of the substrate 1. The mold material 8 is a mold material for the channel, and when the mold material 8 is removed, the removed portion forms the channel. The mold material 8 can be formed with resin or metal. In particular, the mold material 8 is desirably formed with a positive photosensitive resin in terms of removability and patternability. Specifically, vinyl ketone-based photodegradable high molecular weight compounds, such as polymethyl isopropenyl ketone and polyvinyl ketone, and acrylic photodegradable high molecular weight compounds can be used. Examples of the acrylic photodegradable high molecular weight compounds include a copolymer of methacrylic acid and methyl methacrylate, a copolymer of methacrylic acid, methyl methacrylate, and anhydrous methacrylic acid, and the like. The mold material 8 is formed by applying the resin by spin coating, slit coating, or the like, and then patterning the resin. The thickness of the mold material 8 may be set to a desired channel height and preferably set to 2 μm or more and 50 μm or less.

Figure 2G:
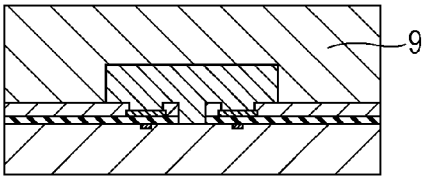

Next, as illustrated in FIG. 2G, the organic material layer 9 is formed in such a manner as to cover the mold material 8. The organic material layer 9 is formed with resin, for example. In FIG. 2G, the organic material layer 9 serves as the channel forming member. In such a case, the organic material layer 9 is desirably formed with a negative photosensitive resin. The organic material layer 9 is positioned on the upper portion of the intermediate layer 7 and contacts the intermediate layer 7 in a portion where the mold material 8 does not exist. More specifically, the intermediate layer 7 contacts the inorganic material layer 3 and the organic material layer 9 between the inorganic material layer 3 and the organic material layer 9.

Figure 2H:
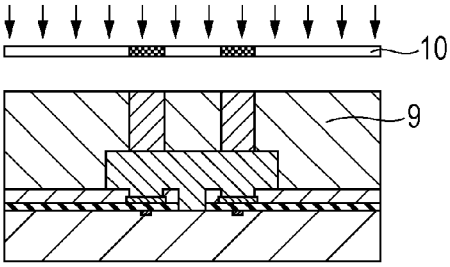

Next, as illustrated in FIG. 2H, exposure of the organic material layer 9 is performed using a mask 10. The organic material layer 9 is desirably formed with a cationic polymerization type epoxy resin composition when considering the mechanical strength, the liquid (ink) resistance, the resolution, and the like. More specifically, the organic material layer 9 desirably contains a cationic photopolymerization type epoxy resin composition containing a bisphenol A epoxy resin, a phenol novolac epoxy resin, a cresol novolac epoxy resin, a multifunctional epoxy resin having an oxycyclohexane skeleton, or the like. By the use of an epoxy resin having two or more functional epoxy groups, a cured substance forms a three-dimensional crosslinking, and therefore a desired property is easily obtained. Examples of the epoxy resins include "CELLOXIDE 2021", "GT-300 series", "GT-400 series", and "EHPE3150" (Trade names) manufactured by Daicel Corporation, "157S70" (Trade name) manufactured by Japan epoxy resin, "EPICLON N-865" (Trade name) manufactured by Dainippon Ink & Chemicals, Inc., and the like.

The epoxy resin composition desirably contains a photopolymerization initiator. Examples of the photopolymerization initiator include sulfonic acid compounds, diazomethane compounds, sulfonium salt compounds, iodonium salt compounds, disulfone compounds, and the like. Specific examples include "ADEKA OPTOMER SP-170", "ADEKA OPTOMER SP-172", and "SP-150" (Trade names) manufactured by ADEKA CORPORATION, "BBI-103" and "BBI-102" (Trade names) manufactured by Midori Kagaku Co., Ltd., "IBPF", "IBCF", "TS-01", and "TS-91" (Trade names) manufactured by Sanwa Chemical Co., Ltd., and the like. Furthermore, the epoxy resin composition can contain basic substances, such as amines, photosensitization substances, such as anthracene derivatives, silane coupling agents, and the like for the purpose of improving the photolithography performance, the adhesion performance, and the like.

In addition thereto, as the organic material layer 9, "SU-8 series" manufactured by Nippon Kayaku Co., Ltd., "TMMR S2000" and "TMMF S2000" (Trade names) manufactured by TOKYO OHKA KOGYO CO., LTD., and the like commercially available as a negative resist may be used.

Examples of a method for forming the organic material layer 9 include, for example, a method including dissolving an organic material, such as a solid-like resin, in a solvent at normal temperature (25° C.), and then applying the solution by spin coating or the like. Examples of such a solvent include an organic solvent. Specific examples include alcohol solvents, such as ethanol and isopropyl alcohol, ketone solvents, such as acetone, methyl isobutyl ketone, diisobutyl ketone, and cyclohexanone, aromatic solvents, such as toluene, xylene, and mesitylene, ethyl lactate, propylene glycol monomethyl ether, diethylene glycol monomethyl ether, diethylene glycol dimethyl ether, and the like. These substances can be used alone or as a mixture.

The organic material layer 9 is a negative photosensitive resin. When exposure thereof is performed, the exposure is performed through a mask 10 having a pattern of the discharge ports using an i-line exposure stepper or the like. Furthermore, by heat-treating (PEB) the organic material layer 9 at a temperature equal to or higher than the softening point of the organic material layer 9, the exposed portion is cured. As the mask 10, the same one as the mask 6 can be used.

Figure 2I:
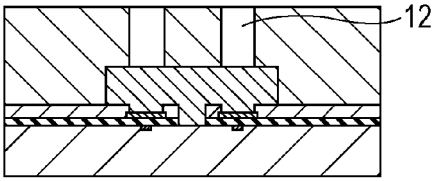

Next, as illustrated in FIG. 2I, the non-exposed portion of the organic material layer 9 is developed with a developing solution to form discharge ports 12 in the organic material layer 9. Examples of the developing solution include Methyl isobutyl ketone (MIBK), xylene, and the like. Rinse treatment with isopropylalcohol (IPA) or the like and post bake may be performed as required.

In FIGS. 2H and 2I, discharge ports are formed in the organic material layer 9 by exposure and development. In such a case, with respect to the organic material layer 9, the thickness on the mold material 8 is preferably 3 μm or more from the viewpoint of mechanical strength and the like. The upper limit of the thickness is not particularly limited insofar as the development properties of the discharge port are not impaired and the thickness on the mold material 8 is preferably 100 μm or less. The front surface of the organic material layer 9 may be subjected to surface modification treatment, such as water-repellent treatment and hydrophillic treatment. In particular, when the organic material layer 9 forms the discharge port, the discharge port surface in which the discharge port opens is desirably subjected to the above-described surface modification treatment.

Figure 2J:
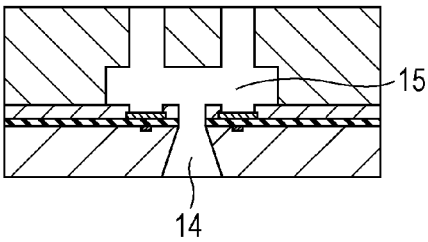

Next, as illustrated in FIG. 2J, a supply port 14 is formed in the substrate 1 by wet etching with an alkaline etching solution, such as TMAH or KOH, or reactive ion etching. Furthermore, the mold material 8 is dissolved and removed to form a channel 15. Finally, the organic material layer 9 is subjected to heat treatment of 150° C. or higher to be sufficiently cured to complete a liquid discharge head.

Intermediate Layer

The present invention has a feature in the configuration of the intermediate layer which is used contacting the inorganic material layer and the organic material layer between the organic material layer and the inorganic material layer in the above-described liquid discharge head. The intermediate layer of the present invention contains a resin having three or more cyclohexene oxide skeletons in the molecules, a photocationic polymerization initiator, a thermal cationic polymerization initiator, and an onium salt containing a cation portion structure represented by (d1) shown below and an anion portion structure represented by (d2) shown below. Hereinafter, the details are described.

Resin Having Three or More Cyclohexeneoxide Skeletons in Molecules

As the resin having three or more cyclohexene oxide skeletons in the molecules, a resin represented by (a1) shown below is desirably used.

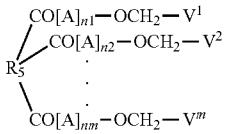

(a1)

[In (a1), $R_5$ represents a hydrocarbon group having 1 to 30 carbon atoms which may contain an alicyclic epoxy group. [A]s each represent any one of —O—, —C(═O)—, and an alkyl group having 1 to 9 carbon atoms which may also contain a branched chain. [A]s may be the same or different from each other. Vs each represent a group represented by (a2) shown below and are bonded to (a1) through * in (a2) shown below. Vs may be the same or different from each other. m represents an integer of 2 or more. The coefficient (n1-nm) of [A] represents 0 or an integer of 1 or more. When m is 2, the resin has one or more cyclohexene oxide skeletons in $R_5$.

(a2)
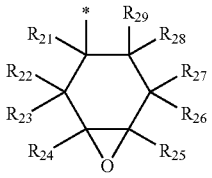
[$R_{21}$ to $R_{29}$ independently represent a hydrogen atom or an alkyl group having 1 to 9 carbon atoms.]
More specific examples of the resin having three or more cyclohexene oxide skeletons in the molecules are shown below.
(a1-1)
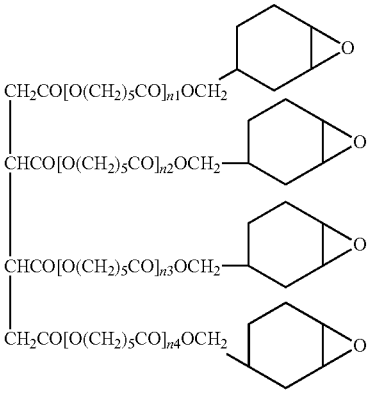
(a1-2)
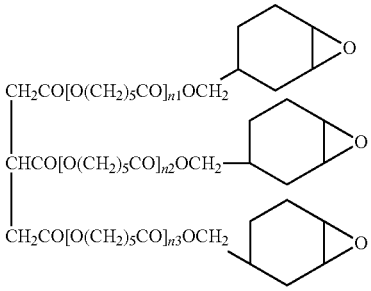
(a1-3)
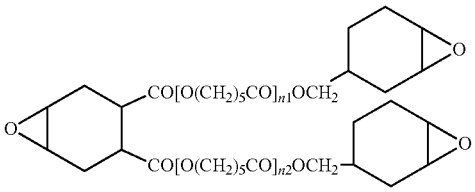
(a1-4)
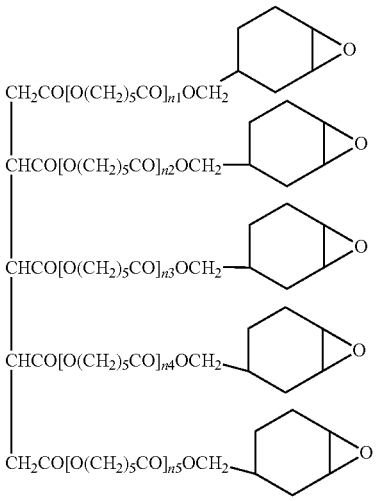
(a1-5)
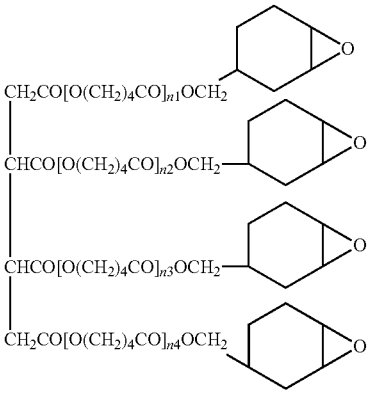
(a1-6)
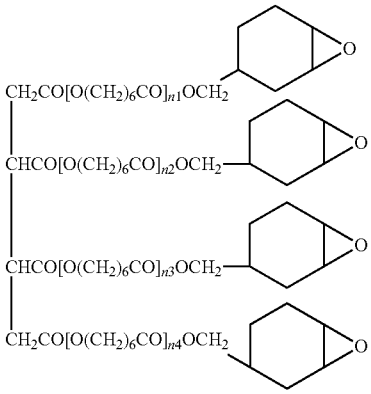

-continued
(a1-7)
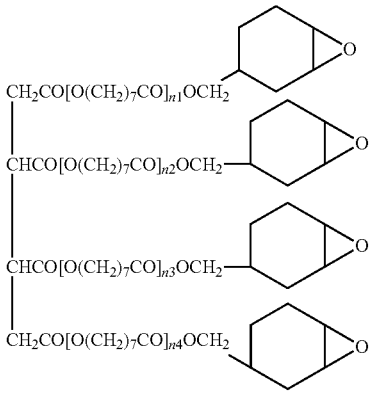
(a1-8)
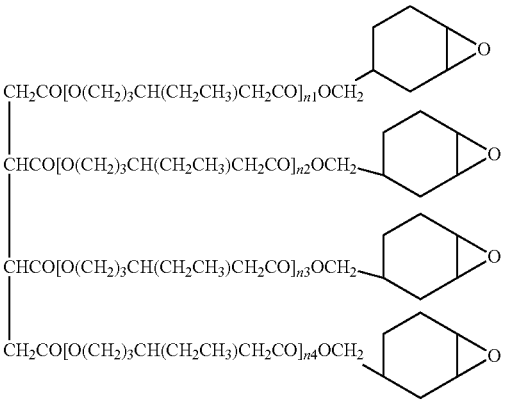
(a1-9)
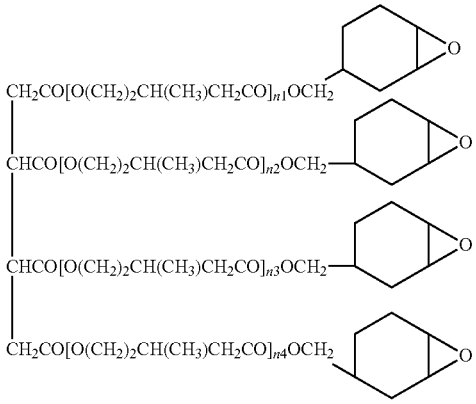
(a1-10)
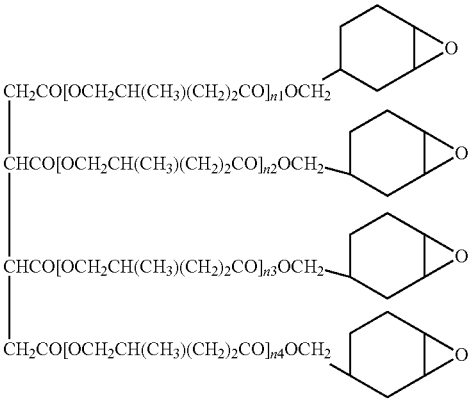
(a1-11)
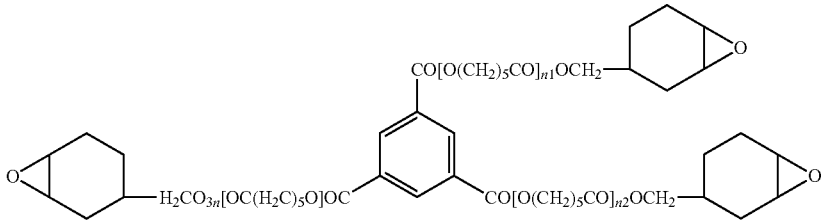
(a1-12)
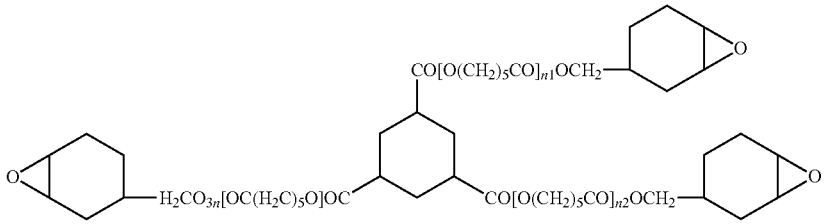
(a1-13)
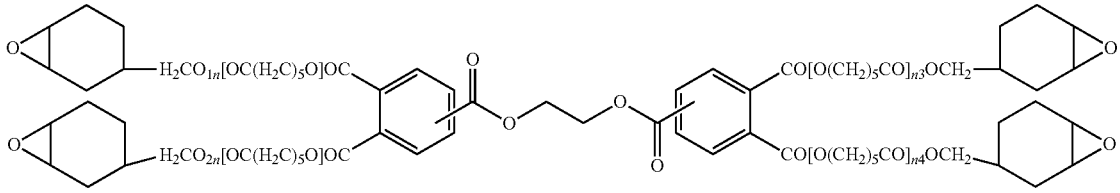

-continued (a1-14)

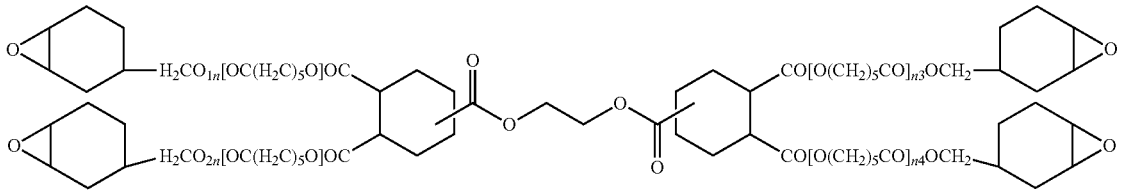

n1 to n4 of (a1-1), (a1-5) to (a1-10), (a1-13), and (a1-14) above each represent an integer which satisfies n1+n2+n3+n4=0 to 20. n1 to n3 of (a1-2), (a1-11), and (a1-12) each represent an integer which satisfies n1+n2+n3=0 to 10. n1 and n2 of (a1-3) each represent an integer which satisfies n1+n2=0 to 5. n1 to n5 of (a1-4) each represent an integer which satisfies n1+n2+n3+n4+n5=0 to 25.

Among the above, examples of commercially available one include "EPOLEAD GT301" equivalent to (a1-3) [One in which n1+n2 in Formula (a1-3) is 1, Epoxy equivalent of 185 to 205, manufactured by Daicel Corporation] and, in addition thereto, "EPOLEAD GT302" [One in which n1+n2 in Formula (a1-3) is 2, Epoxy equivalent of 225 to 250, manufactured by Daicel Corporation]. Moreover, "EPOLEAD GT401" [One in which n1+n2+n3+n4 in Formula (a1-1) is 1, Epoxy equivalent of 210 to 225, manufactured by Daicel Corporation] is mentioned. Moreover, "EPOLEAD GT403" [One in which n1+n2+n3+n4 in Formula (a1-1) is 3, Epoxy equivalent of 270 to 300, manufactured by Daicel Corporation] is mentioned.

Among the resins having three or more cyclohexene oxide skeletons in the molecules, a resin having four or more cyclohexene oxide skeletons in the molecules is desirable in terms of peeling resistance. Among the above, (a1-1), (a1-4) to (a1-10), (a1-13), and (a1-14) are equivalent to the resin.

The content of the resin having three or more cyclohexene oxide skeletons in the molecules in the intermediate layer is preferably 1% by mass or more, more preferably 3% by mass or more, and still more preferably 5% by mass or more from the viewpoint of obtaining an intermediate layer having high sensitivity, good hardness, and high peeling resistance. The content is preferably 70% by mass or less and more preferably 60% by mass or less from the viewpoint of obtaining an intermediate layer having a good applied surface state.

Since the cyclohexene oxide skeleton of the resin having three or more cyclohexene oxide skeletons in the molecules exhibits high cationic polymerization properties and easily obtains high crosslink density, a cured substance excellent in chemical resistance can be obtained. Therefore, the resistance against an ink having high solvent ratio, for example, also becomes high. In addition thereto, due to the fact that the resin has the [A] skeleton (any one —O—, —C(=O)—, and an alkyl group having 1 to 9 carbon atoms which may also contain a branched chain), the mechanical strength of the cured substance becomes good. Therefore, peeling due to a linear expansion coefficient difference between the inorganic material layer and the organic material layer can also be suppressed. Furthermore, the adhesiveness with the organic material layer formed with an organic material becomes good.

Cationic Photopolymerization Initiator

Examples of the photocationic polymerization initiator include an onium salt, a borate salt, a triazine compound, an azo compound, a peroxide, and the like. Aromatic sulfonium salts or aromatic iodonium salts are desirable in terms of sensitivity, stability, reactivity, and solubility. Examples of the aromatic sulfonium salt include, for example, TPS-102, 103, 105, MDS-103, 105, 205, and DTS-102, 103 commercially available from Midori Kagaku Co., Ltd., SP-170 and 172 commercially available from ADEKA, and the like. Examples of the aromatic iodonium salt include DPI-105, MPI-103, 105, BBI-102, 103, and 105 commercially available from Midori Kagaku Co., Ltd. and the like.

In terms of sensitivity to i-lines (Wavelength of 365 nm), it is desirable to use an onium salt containing a cation portion structure represented by (b1) shown below and an anion portion structure represented by (b2) shown below and containing a 1 to 1 combination of the cation portion structure and the anion portion structure as the photocationic polymerization initiator.

(b1)

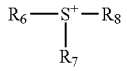

(b2)

[In the cation portion structure represented by (b1), $R_6$ to $R_8$ independently represent an organic group having 1 to 30 carbon atoms which may have a substituent. However, at least two or more oxygen atoms are contained in all the constituent atoms of $R_6$ to $R_8$. In the anion portion structure represented by (b2), X represents any one of a carbon atom, a nitrogen atom, a phosphorus atom, and a boron atom. Y represents any one of $—S(=O)_2—$, an alkylene fluoride group, $—O—CF_2—$, $—C(=O)—CF_2—$, $—O—C(=O)—CF_2—$, $—C(=O)—O—CF_2—$ and a single bond. $R_9$ represents a hydrocarbon group having 1 to 30 carbon atoms which may be replaced by a fluorine atom. g and h each represent an integer which satisfies g+h=3 and any one of h=0, 1, or 2 when X is a carbon atom, represent an integer which satisfies g+h=2 and any one of h=0 or 1 when X is a nitrogen atom, represent an integer which satisfies g+h=6 and any one of h=0 to 6 when X is a phosphorus atom, and represent an integer which satisfies g+h=4 and any one of h=0 to 3 when X is a boron atom.]

The cation portion structure represented by (b1) desirably contains a cyclic carbonyl structure from the viewpoint of having high i-line photosensitivity and more desirably contains a heterocyclic group including a cyclic carbonyl structure. It is desirable that at least one of $R_6$ to $R_8$ contains a cyclic carbonyl structure and it is more desirable that two or more of $R_6$ to $R_8$ contain a cyclic carbonyl structure. When the carbonyl group exists in a conjugated system, the carbonyl group greatly contributes to extend the wavelength of the absorption. In particular, due to the fact that the conjugated system contains an aromatic ring, the sensitivity to i-lines improves.

In the anion portion structure represented by (b2), $R_9$ is desirably a hydrocarbon group having one or more fluorine atoms when h=0 is established and Y is —S(=O)$_2$— or a single bond. When g is 2 or more, any one of carbon atoms of one of $R_9$s and any one of carbon atoms of the other one of $R_9$s may be bonded to each other through a single bond to form a ring structure. Examples of $R_9$ include an alkyl group or an aryl group which may be replaced by a fluorine atom, for example. X is desirably a phosphorus atom. In the case of a Lewis acid system, i.e., when X is a phosphorus atom, the cured film (intermediate layer) to be formed tends to have excellent heat resistance.

One example of the cation portion structure represented by (b1) and one example of the anion portion structure represented by (b2) are shown below.

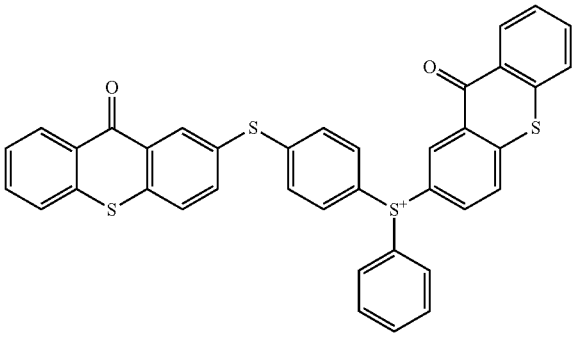

One example of (b1)

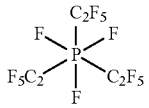

One example of (b2)

A feature of the cation portion structure represented by (b1) resides in having high sensitivity to i-lines and the like because the extension of the wavelength of the absorption wavelength of the photocationic polymerization initiator can be achieved due to containing two or more oxygen atoms. On the other hand, in the anion portion structure represented by (b2), the (b1) component is decomposed after the exposure to generate acid resulting from the structure of (b2). Thereafter, the cationic polymerization reaction of the epoxy group in the resin can be initiated and promoted by the action of the generated acid. The generated acid more desirably has acid strength which allows sufficient curing of the resin having an epoxy group. The acid strength which allows sufficient curing of the resin having an epoxy group means, in the case of Lewis acid, strong acid stronger than hexafluoroantimonate, i.e., larger than the Hammett acidity function —HO=18. In the case of Broensted acid, the acid strength means strong acid equal to or stronger than nonafluorobutanesulfonate, i.e., PKa=−3.57 or more.

When the use amount of the photocationic polymerization initiator to the cationic polymerization properties monomer is small, the curing rate tends to become low. Moreover, the peeling resistance tends to decrease. Therefore, the content of the photocationic polymerization initiator in the intermediate layer is preferably 0.01% by mass or more and more preferably 0.05% by mass or more. When the use amount of the photocationic polymerization initiator is excessively large, there is a tendency for the transmittance of a coating film to decrease or for the storage stability of a solution to decrease. Therefore, the content of the photocationic polymerization initiator in the intermediate layer is preferably 30% by mass or less and more preferably 20% by mass or less.

Thermal Cationic Polymerization Initiator

As the thermal cationic polymerization initiator, the thermal cationic polymerization initiator itself desirably does not have photosensitivity in obtaining the intermediate layer capable of performing pattern formation with high accuracy and high sensitivity. In particular, when i-lines are used in the exposure, the thermal cationic polymerization initiator itself desirably does not have photosensitivity to the i-lines.

Examples of the thermal cationic polymerization initiator for use in the present invention include copper triflate (trifluoromethanesulfonic acid copper (II)), ascorbic acid, and the like. Moreover, an onium salt containing a cation portion structure of a heterocyclic derivative represented by (c1) shown below and an anion portion structure represented by (c2) is mentioned.

(c1)

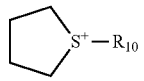

(c2)

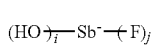

[In the cation portion structure represented by (c1), $R_{10}$ represents a hydrocarbon group having 1 to 9 carbon atoms. In the anion portion structure represented by (c1), i and j each represent an integer which satisfies i+j=6 and any one of i=0 to 6.]

The thermal cationic polymerization initiator is desirably the onium salt containing the cation portion structure of the heterocyclic derivative represented by (c1) and the anion portion structure represented by (c2) shown above in terms of storage stability. In particular, the onium salt containing the cation portion structure of the heterocyclic derivative in which $R_{10}$ is a straight chain hydrocarbon group having 1 to 9 carbon atoms is excellent in storage stability and is desirably used for the present invention. Specific examples of such a component are shown below.

(c1-1)

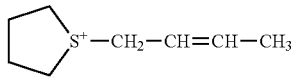

(c2-1)

$SbF_6^-$ (c1-1) above is a cation portion structure of a heterocyclic derivative having a straight chain hydrocarbon group and (c2-1) above is one of desirable specific examples of the anion portion structure represented by (c2).

In the present invention, by the use of the thermal cationic polymerization initiator in combination with the photocationic polymerization initiator, both the initiators synergistically act, and thus the crosslinking density of the intermediate layer becomes high by a heating process after light irradiation, so that the adhesiveness with the inorganic material layer can be further increased.

Examples of the inorganic material layer of the present invention include silicon oxide ($SiO_2$), silicon nitride (SiN), silicon carbide (SiC), and silicon carbonitride (SiCN), Ta, and the like. The adhesiveness of the inorganic material layer and the intermediate layer can be particularly increased due to the action of the resin having three or more cyclohexene oxide skeletons in the molecules and the thermal cationic polymerization initiator described above.

The thermal cationic polymerization initiator acts as the polymerization initiator even when used alone. However, when the content is excessively large, the epoxy polymerization reaction progresses by the heat treatment (PEB process) and the like to be performed after the exposure, which causes degradation of the pattern shape in some cases. Therefore, the content of the thermal cationic polymerization initiator in the intermediate layer is desirably set to satisfy the following relational expression. Relational expression; Mole number of thermal cationic polymerization initiator×(1/2)>Mole number of photocationic polymerization initiator When satisfying the relational expression, the thermal cationic polymerization initiator hardly reduces the patternability of the intermediate layer and also can increase the adhesion strength of the intermediate layer.

Moreover, in order for the intermediate layer to demonstrate sufficient adhesion strength, it is desirable to perform heat-treatment at 140° C. or higher in the heat treatment after the patterning. By applying heat of 140° C. or higher to the intermediate layer, the effect of containing the thermal cationic polymerization initiator is further demonstrated and the intermediate layer can develop sufficient adhesion strength.

Onium Salt Containing Cation Portion Structure Represented by (d1) and Anion Portion Structure Represented by (d2)

An onium salt (hereinafter also referred to as a (d) component) containing a cation portion structure represented by (d1) and an anion portion structure represented by (d2) contains a 1 to 1 combination of the cation portion structure (d1) and the anion portion structure (d2) having the following specific structures.

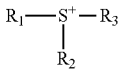

(d1)

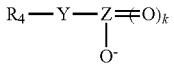

(d2)

[In the cation portion structure represented by (d1), $R_1$ to $R_3$ independently represent an organic group having 1 to 15 carbon atoms which may have a substituent. In the anion portion structure represented by (d2), Z represents a carbon atom or a sulfur atom, and when Z is a carbon atom, k=1 is established and when Z is a sulfur atom, k=2 is established. Y represents any one of —S(=O)$_2$—, an alkylene fluoride group having 1 to 15 carbon atoms, —O—CF$_2$—, —C(=O)—CF$_2$—, —O—C(=O)—CF$_2$—, —C(=O)—O—CF$_2$—, and a single bond. $R_4$ represents a hydrocarbon group having 1 to 20 carbon atoms which may contain a hetero atom.]

In the cation portion structure represented by (d1), $R_1$ to $R_3$ each represent, for example, an aryl group having 6 to 15 carbon atoms in total or an alkyl group having 1 to 15 carbon atoms in total and the groups may be replaced by, for example, at least one selected from the group consisting of the groups of an alkyl group, an alkyl fluoride group, a hydroxy group, a cycloalkyl group, an alkoxy group, an alkyl carbonyl group, an arylcarbonyl group, an arylthio group, an alkylthio group, an aryl group, and an aryloxy group and halogen atoms. More specifically, examples of the substituents include, for example, the groups, such as alkyl groups having 1 to 6 carbon atoms (e.g., a methyl group, an ethyl group, a propyl group, an isopropyl group, and a butyl group), alkyl fluoride groups having 1 to 6 carbon atoms (e.g., a trifluoromethyl group and a pentafluoroethyl group), hydroxy groups, cycloalkyl groups having 3 to 6 carbon atoms (e.g., a cyclopropyl group, a cyclobutyl group, a cyclopentyl group, and a cyclohexyl group), alkoxy groups having 1 to 6 carbon atoms (e.g., a methoxy group, an ethoxy group, an n-propoxy group, an iso-propoxy group, an n-butoxy group, and a tert-butoxy group), alkyl carbonyl groups having 2 to 6 carbon atoms, aryl carbonyl groups having 7 to 11 carbon atoms, arylthio groups having 6 to 10 carbon atoms (e.g., a phenylthio group and a naphthylthio group), alkylthio groups having 1 to 6 carbon atoms (e.g., a methylthio group, an ethylthio group, an n-propylthio group, an iso-propylthio group, an n-butylthio group, and a tert-butyl thio group), aryl groups having 6 to 10 carbon atoms (e.g., a phenyl group and a naphthyl group), and aryloxy groups having 6 to 10 carbon atoms (e.g., a phenoxy group and a naphthoxy group), halogen atoms (e.g., a chlorine atom, a bromine atom, and a fluorine atom), and the like. $R_2$ to $R_3$ may be the same or different from each other. Two or more Rs of $R_1$ to $R_3$ may be bonded to each other directly or through —O—, —S—, —SO—, —SO$_2$—, —NH—, —NR$_a$, —CO—, —C(=O)O—, —C(=O)NH—, an alkylene or phenylene group having 1 to 3 carbon atoms to form a ring structure.

In the anion portion structure represented by (d2), $R_4$ represents, for example, alkyl groups having 1 to 20 carbon atoms in total or aryl groups having 6 to 20 carbon atoms in total, and these groups may be replaced by at least one selected from the group consisting of an alkyl group, an oxo group, a cycloalkyl group, an alkoxy group, and an alkyl carbonyl group, for example. More specifically, examples of these substituents include, for example, alkyl groups having 1 to 10 carbon atoms (e.g., a methyl group, an ethyl group, a propyl group, an isopropyl group, and a butyl group), cycloalkyl groups having 3 to 6 carbon atoms (e.g., a cyclopropyl group, a cyclobutyl group, a cyclopentyl group, and a cyclohexyl group), alkoxy groups having 1 to 6 carbon atoms (e.g., a methoxy group, an ethoxy group, an n-propoxy group, an iso-propoxy group, an n-butoxy group, and a tert-butoxy group), alkylcarbonyl groups having 2 to 6 carbon atoms, and the like. $R_4$ may form a ring structure by bonding of two or more carbon atoms to each other directly or through alkylene having 1 to 3 carbon atoms. The cyclic structure may be a monocyclic structure or a polycyclic structure.

In the anion portion structure represented by (d2), $R_4$ is desirably a structure containing an aromatic hydrocarbon group or an alicyclic hydrocarbon group. In the case of the structure containing an aromatic hydrocarbon group or an alicyclic hydrocarbon group, the bulkiness and the carbon density thereof prevent acid generated from the anion portion structure represented by (d2) from volatilizing in the heating process to evaporate into the air atmosphere. In the anion portion structure represented by (d2), Z is desirably a sulfur atom. When Z is a sulfur atom, the anion portion structure can be further stabilized as compared with the case where Z is a carbon atom. Therefore, the nucleophilicity of the anion portion structure is suppressed, so that the decomposition of the (d) component caused by the nucleophilic attack to the cation portion structure represented by (d1) by the anion portion structure can be suppressed.

Examples of (d1) and (d2) are shown below. One example of (d1) One example of (d2)

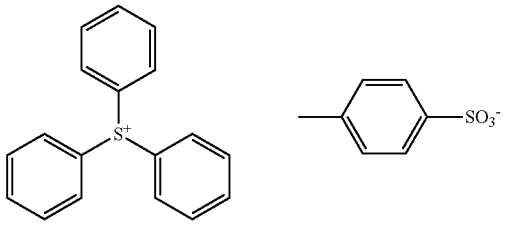

After the exposure, the photocationic polymerization initiator initiates and promotes the cationic polymerization reaction of the epoxy group, and therefore the photocationic polymerization initiator is suitable for the exposure in this respect. On the other hand, when acid diffuses into the intermediate layer, the non-exposed portion is cured to reduce the resolution in some cases. The thermal cationic polymerization initiator is suitable for increasing the adhesion strength of the inorganic material layer and the intermediate layer. On the other hand, the storage stability of the thermal cationic polymerization initiator is low and the curing of the epoxy group gradually advances under a non-heating environment, and therefore the thermal cationic polymerization initiator is difficult to store over a long period of time.

As measures for solving the problems, the (d) component is used in the present invention. When acid given, by protons, to the anion portion structure represented by (d2) is presumed, the anion portion structure represented by (d2) in the (d) component has a weak acid structure which cannot achieve epoxy polymerization or in which the acidity which causes polymerization is very low. Therefore, when strong acid which causes epoxy polymerization encounters the (d) component, salt exchange occurs, so that the strong acid is converted to weak acid which cannot achieve epoxy polymerization or which is difficult to cause polymerization. More specifically, the (d) component can function as a good quencher to acid which promotes epoxy polymerization in the epoxy polymerization. As a result, when the intermediate layer contains the (d) component, the development contrast can be increased, and thus a pattern with higher resolution can be obtained. In addition thereto, a dark reaction can be inhibited, so that the intermediate layer excellent in storage stability can be obtained.

The anion portion structure represented by (d2) is desirably an anion portion structure represented by (d20) shown below in terms of storage stability.

(d20)

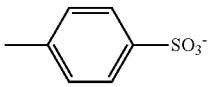

The (d) component can be used alone or in combination of two or more kinds thereof.

The content of the (d) component in the intermediate layer is preferably 0.001% by mass or more from the viewpoint of an improvement of the resolution or an improvement of storage stability. The content is preferably 6% by mass or less and more preferably 4% by mass or less from the viewpoint of the polymerization and the peeling resistance of a cured substance.

The content ratio of the photocationic polymerization initiator, the thermal cationic polymerization initiator, and the (d) component in the intermediate layer is desirably set to satisfy the following relational expression.

Relational Expression; Mole Number of Photocationic Polymerization Initiator+Mole Number Thermal Cationic Polymerization Initiator>Mole Number of (d) Component When satisfying the relational expression, the content of the photocationic polymerization initiator and the thermal cationic polymerization initiator which generate acid effective for epoxy polymerization is higher than the content of the (d) component which functions as a quencher, and thus the sensitivity of the adhesion layer can be increased.

Organic Solvent

The intermediate layer can be applied while containing an organic solvent. The organic solvent can be used in order to adjust the viscosity of the intermediate layer for use in the present invention, for example, and, by adjusting the addition amount thereof to a suitable addition amount, the intermediate layer with a good applied face state is obtained.

The organic solvent is not particularly limited and may be a solvent which can be used when dissolving each of the components described above contained in the intermediate layer to prepare the intermediate layer. Examples of the solvent include organic solvents, such as alkylene glycol monoalkyl ether carboxylates, alkylene glycol monoalkyl ethers, alkyl lactate esters, alkyl alkoxy propionates, cyclic lactones (preferably 4 to 10 carbon numbers), monoketone compounds (preferably 4 to 10 carbon atoms) which may contain a ring, alkylene carbonates, alkyl alkoxyacetates, alkyl pyruvates, and compounds having a benzene ring.

As the alkylene glycol monoalkyl ether carboxylates, propylene glycol monomethyl ether acetate, propylene glycol monoethyl ether acetate, propylene glycol monopropyl ether acetate, propylene glycol monobutyl ether acetate, propylene glycol monomethyl ether propionate, propylene glycol monoethyl ether propionate, ethylene glycol monomethyl ether acetate, and ethylene glycol monoethyl ether acetate are desirably mentioned, for example. As the alkylene glycol monoalkyl ethers, propylene glycol monomethyl ether, propylene glycol monoethyl ether, propylene glycol monopropyl ether, propylene glycol monobutyl ether, ethylene glycol monomethyl ether, and ethylene glycol monoethyl ether are desirably mentioned, for example. As the alkyl lactate esters, methyl lactate, ethyl lactate, propyl lactate, and butyl lactate are desirably mentioned, for example. As the alkyl alkoxy propionates, 3-ethoxy ethyl propionate, 3-methoxy methyl propionate, 3-ethoxy methyl propionate, and 3-methoxy ethyl propionate are desirably mentioned, for example. As the cyclic lactones, β-propiolactone, β-butyrolactone, γ-butyrolactone, α-methyl-γ-butyrolactone, β-methyl-γ-butyrolactone, γ-valerolactone, γ-caprolactone, γ-octanoic lactone, and α-hydroxy-γ-butyrolactone are desirably mentioned, for example. As the monoketone compounds which may contain a ring, 2-butanone, 3-methyl butanone, pinacolone, 2-pentanone, 3-pentanone, 3-methyl-2-pentanone, 4-methyl-2-pentanone, 2-methyl-3-pentanone, 4,4-dimethyl-2-pentanone, 2,4-dimethyl-3-pentanone, 2,2,4,4-tetramethyl-3-pentanone, 2-hexanone, 3-hexanone, 5-methyl-3-hexanone, 2-heptanone, 3-heptanone, 4-heptanone, 2-methyl-3-heptanone, 5-methyl-3-heptanone, 2,6-dimethyl-4-heptanone, 2-octanone, 3-octanone, 2-nonanone, 3-nonanone, 5-nonanone, 2-decanone, 3-decanone, 4-decanone, 5-hexene-2-one, 3-pentene-2-one, cyclopentanone, 2-methylcyclopentanone, 3-methylcyclopentanone, 2,2-dimethyl cyclopentanone, 2,4,4-trimethyl cyclopentanone, cyclohexanone, 3-methyl cyclohexanone, 4-methyl cyclohexanone, 4-ethyl cyclohexanone, 2,2-dimethyl cyclohexanone, 2,6-dimethyl cyclohexanone, 2,2,6-trimethyl cyclohexanone, cycloheptanone, 2-methyl cycloheptanone, and 3-methyl cycloheptanone are desirably mentioned, for example. As the alkylene carbonates, propylene carbonate, vinylene carbonate, ethylene carbonate, and butylene carbonate are desirably mentioned, for example. As the alkyl alkoxyacetates, 2-methoxyethyl acetate, 2-ethoxyethyl acetate, 2-(2-ethoxyethoxy)ethyl acetate, 3-methoxy-3-methylbutyl acetate, and 1-methoxy-2-propyl acetate are desirably mentioned, for example. As the alkyl pyruvates, methyl pyruvate, ethyl pyruvate, and propyl pyruvate are desirably mentioned, for example. As the compounds having a benzene ring, benzene, toluene, ethyl benzene, orthoxylene, metaxylene, and paraxylene are desirably mentioned. When indicated as xylene, a mixture of orthoxylene, metaxylene, paraxylene, ethyl benzene, and the like may be acceptable.

Examples of the organic solvent which can be desirably used include solvents having a boiling point of 110° C. or higher under normal temperature (25° C.) and under normal pressure. Specific examples include cyclopentanone, γ-butyrolactone, cyclohexanone, ethyl lactate, ethylene glycol monoethyl ether acetate, propylene glycol monomethyl ether acetate, 3-ethoxy propionate ethyl, ethyl pyruvate, 2-ethoxyethyl acetate, 2-(2-ethoxyethoxy)ethyl acetate, propylene carbonate, and xylene. In the present invention, the solvents may be used alone or in combination of two or more kinds thereof.

The content of the (d) component in the application to the substrate in the intermediate layer is preferably 5% by mass or more and more preferably 10% by mass or more from the viewpoint of the dissolution of each component contained in the intermediate layer. The content is preferably 90% by mass or less and more preferably 85% by mass or less from the viewpoint of obtaining a suitable film thickness. Thus, when applied, the intermediate layer with a good applied face state is obtained.

Silane Compound

The intermediate layer may contain a silane compound. When the silane compound is contained, the silane compound can improve or assist the adhesiveness between the inorganic material layer and the intermediate layer. The silane compound is not particularly limited and organo silane compounds are desirable. Examples include, for example, those having epoxy groups, such as γ-glycidoxypropyltrimethoxysilane, γ-glycidoxypropylmethyl diethoxy silane, γ-glycidoxypropyl triethoxy silane, and β-(3,4-epoxycyclohexyl) ethyl trimethoxy silane, those having amino groups, such as N-β(aminoethyl)-γ-aminopropyl trimethoxysilane, N-β(aminoethyl)-γ-aminopropyl triethoxysilane, γ-β(aminoethyl) 3-aminopropyl methyl dimethoxysilane, γ-aminopropyl trimethoxysilane, γ-aminopropyl triethoxysilane, N-phenyl-γ-aminopropyl trimethoxysilane, N-phenyl γ-aminopropyl triethoxysilane, γ-triethoxysilyl-N-(1,3-dimethyl-butylidene) propylamine, and N-(vinylbenzyl)-β-aminoethyl-γ-aminopropyl trimethoxysilane, those having isocyanate groups, such as 3-isocyanatepropyl trimethoxysilane and 3-isocyanatepropyl triethoxysilane, and those having mercapto groups, such as γ-mercaptopropyl trimethoxysilane, γ-mercaptopropylmethyl dimethoxysilane, and γ-mercaptopropyl triethoxysilane.

As the silane compound, a silane compound having an epoxy group is desirable and, for example, "SILQUEST A-187 SILANE" manufactured by Momentive Performance Materials Inc. Japan, LLC is mentioned.

Other Epoxy Resins

The intermediate layer may contain an epoxy resin which is different from the resin having three or more cyclohexene oxide skeletons in the molecules in terms of resolution or hardness. Such an epoxy resin is desirably an epoxy resin containing an aromatic group or an epoxy resin containing an alicyclic group in terms of the purpose described above.

The epoxy resin containing an aromatic group is desirably a multifunctional aromatic epoxy resin compound having two or more epoxy groups in one molecule. Examples of such a multifunctional aromatic epoxy resin include a multifunctional phenol novolac epoxy resin, a multifunctional orthocresol novolac epoxy resin, a multifunctional triphenyl novolac epoxy resin, a multifunctional bisphenol A novolac epoxy resin, a multifunctional bisphenol F novolac epoxy resin, a multifunctional bisphenol A epoxy resin, a multifunctional bisphenol F epoxy resin, and the like. Examples include, for example, "EPICOAT157S70" manufactured by Japan epoxy resin, "EP-4000S" manufactured by ADEKA, "EP-4010S" manufactured by ADEKA, "EPICLON N-865" manufactured by Dainippon Ink & Chemicals, Inc., and the like.

The epoxy resin containing an alicyclic group is desirably a multifunctional epoxy resin compound containing an epoxy group in one molecule and containing an alicyclic group different from that of a cyclohexene oxide skeleton. Examples of such a multifunctional epoxy resin include a multifunctional alicyclic epoxy resin and a hydrogenated epoxy resin in which a multifunctional aromatic epoxy resin is hydrogenated. Examples of the multifunctional aromatic epoxy resin include a multifunctional phenol novolac epoxy resin, a multifunctional orthocresol novolac epoxy resin, a multifunctional triphenyl novolac epoxy resin, a multifunctional bisphenol A novolac epoxy resin, a multifunctional bisphenol F novolac epoxy resin, a multifunctional bisphenol A epoxy resin, a multifunctional bisphenol F epoxy resin, and the like. Among the above, examples of the multifunctional alicyclic epoxy resin include "EHPE 3150" manufactured by Daicel Corporation, examples of the hydrogenated epoxy resin include "ST-4000D" manufactured by Nippon Steel Chemical Co., Ltd., and the like, for example.

When these epoxy resins are used as other epoxy resins, the content of other epoxy resins in the intermediate layer is preferably 0.02% by mass or more and more preferably 0.2% by mass or more in order to sufficiently obtain the effect of incorporating other epoxy resins. The content is preferably 80% by mass or less and more preferably 70% by mass or less from the viewpoint of sufficiently obtaining the effects of stabilizing the applied face state and the resin having three or more cyclohexene oxide skeletons in the molecules. By adjusting the content in this range, the intermediate layer having appropriate resolution and hardness and having a good applied face state when applied is obtained.

Additive

The intermediate layer may contain other additives for the purpose of an increase in crosslinking density, an improvement of application properties, an improvement of water resistance, an improvement of solvent resistance, imparting flexibility, an improvement of adhesion strength with a substrate, and the like. For example, SP-100 manufactured by ADEKA and the like may be contained as a wavelength sensitizer. A plurality kinds of these additives may be mixed to be contained.

EXAMPLES

The present invention is described in more detail with reference to Examples shown below.

Intermediate Layer Forming Composition

Materials shown in Table 1 shown below were mixed to give compositions of Examples 1 to 25 and Comparative Examples 1 to 4 for forming an intermediate layer. The unit in Table 1 is "part(s) by mass".

TABLE 1

| Components | | Examples 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| (a) component | (a-1) | 100 | — | — | 100 | 100 | 100 | 80 | 80 | 80 | 80 | 30 | 30 | 5 | 1 | 100 |
| | (a-2) | — | 100 | — | — | — | — | — | — | — | — | — | — | — | — | — |
| | (a-3) | — | — | 100 | — | — | — | — | — | — | — | — | — | — | — | — |
| (b) component | (b-1) | 1 | 1 | 1 | — | 1 | 1 | 1 | 1 | 1 | 1 | 1 | 1 | 1 | 1 | 1 |
| (c) component | (c-1) | 0.3 | 0.3 | 0.3 | 0.3 | — | — | 0.3 | — | 0.3 | — | 0.3 | — | 0.3 | 0.3 | 0.3 |
| | (c-2) | — | — | — | — | 0.3 | — | — | — | — | — | — | — | — | — | — |
| | (c-3) | — | — | — | — | — | 0.3 | — | 0.3 | — | 0.3 | — | 0.3 | — | — | — |
| (d) component | (d-1) | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 |
| (e) component | (e-1) | 100 | 100 | 100 | 100 | 100 | 100 | 100 | 100 | 100 | 100 | 100 | 100 | 100 | 100 | 60 |
| (f) component | (f-1) | 5 | 5 | 5 | 5 | 5 | 5 | 5 | 5 | 5 | 5 | 5 | 5 | 5 | 5 | 5 |
| (g) component | (g-1) | — | — | — | — | — | — | 20 | 20 | — | — | — | — | — | — | — |
| | (g-2) | — | — | — | — | — | — | — | — | 20 | 20 | — | — | — | — | — |
| | (g-3) | — | — | — | — | — | — | — | — | — | — | 70 | 70 | 95 | 99 | — |
| Others | (z-2) | — | — | — | — | — | — | — | — | — | — | — | — | — | — | — |

| | | Examples 16 | 17 | 18 | 19 | 20 | 21 | 22 | 23 | 24 | 25 | Comparative Examples 1 | 2 | 3 | 4 |
|---|---|---|---|---|---|---|---|---|---|---|---|---|---|---|---|
| (a) component | (a-1) | 100 | 100 | 100 | 100 | 100 | 100 | 100 | 100 | 80 | 30 | — | — | 100 | 100 |
| | (a-2) | — | — | — | — | — | — | — | — | — | — | — | — | — | — |
| | (a-3) | — | — | — | — | — | — | — | — | — | — | — | — | — | — |
| (b) component | (b-1) | 1 | 0.1 | 0.01 | 60 | 12.5 | 12.5 | 1 | 1 | 1 | 1 | — | 1 | 1 | 1 |
| (c) component | (c-1) | | | | | | | | | | | | | | |
| | (c-2) | 0.3 | 0.03 | 0.003 | 5 | 5 | 5 | 0.3 | 0.3 | 0.3 | 0.3 | — | 0.3 | — | 0.3 |
| | (c-3) | — | — | — | — | — | — | — | — | — | — | — | — | — | — |
| (d) component | (d-1) | — | — | — | — | — | — | — | — | — | — | — | — | — | — |
| (e) component | (e-1) | 0.2 | 0.02 | 0.004 | 1 | 10 | 15 | - | 0.2 | 0.2 | 0.2 | — | 0.2 | 0.2 | — |
| (f) component | (f-1) | 35 | 100 | 100 | 100 | 100 | 100 | 100 | 100 | 100 | 100 | — | 100 | 100 | 100 |
| (g) component | (g-1) | 5 | 5 | 5 | 5 | 5 | 5 | 5 | 5 | 5 | 5 | — | 5 | 5 | 5 |
| | (g-2) | — | — | — | — | — | — | — | — | 20 | — | — | — | — | — |
| | (g-3) | — | — | — | — | — | — | — | — | — | — | — | — | — | — |
| Others | (z-2) | — | — | — | — | — | — | — | — | — | 70 | — | — | — | — |
| (a) component | (a-1) | — | — | — | — | — | — | — | — | — | — | — | 100 | — | — |
| Peeling resistance | | A | A | B | A | A | A | A | A | A | A | A | A | B | C | A |
| Resolving power | | <0.5 | <0.5 | <0.5 | 0.8 | <0.5 | <0.5 | <0.5 | <0.5 | <0.5 | <0.5 | <0.5 | <0.5 | <0.5 | <0.5 | <0.5 |
| Storage stability | | A | A | A | A | B | B | A | B | A | B | A | B | A | A | A |
| Appliedfacestate | | A | A | A | A | A | A | A | A | A | A | A | A | A | A | B |
| Peeling resistance | | A | B | C | B | B | C | A | A | A | A | D | D | D | A | |
| Resolving power | | <0.5 | <0.5 | 0.5 | <0.5 | <0.5 | <0.5 | <0.5 | <0.5 | <0.5 | <0.5 | — | <0.5 | <0.5 | 1.1 | |
| Storage stability | | A | A | B | B | A | A | B | A | A | A | A | A | A | C | |
| Appliedfacestate | | C | A | A | A | A | A | A | A | A | A | A | A | A | A | |

(a-1): EPOLEAD GT401 (manufactured by Daicel Corporation), Epoxy Equivalent of 210 to 225

(a-2): EPOLEAD GT403 (manufactured by Daicel Corporation), Epoxy equivalent of 270 to 300

(a-3): EPOLEAD GT301 (manufactured by Daicel Corporation), Epoxy equivalent of GT185 to 205

(b-1): Onium salt containing a cation portion structure represented by (b10) and an anion portion structure represented by (b20)

(b10)

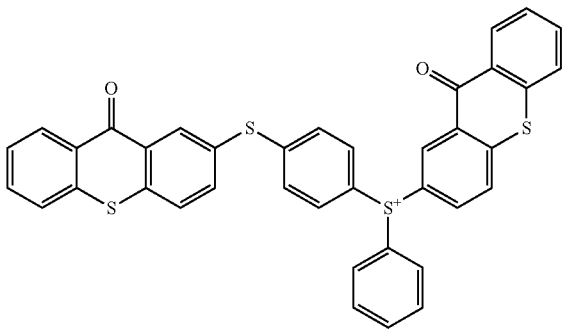

-continued (b20)

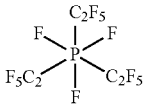

(b-2): Onium salt containing a cation portion structure represented by (b11) and an anion portion structure represented by (b21)

(b11)

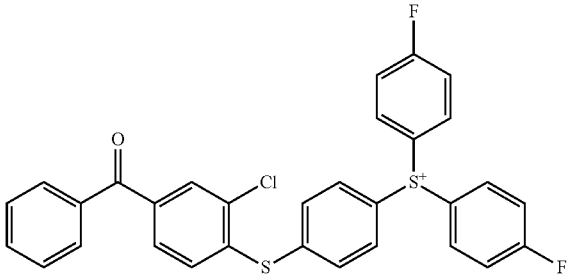

(b21)

(c-1): Onium salt containing a cation portion structure of a heterocyclic derivative having a straight chain hydrocarbon group represented by (c10) and an anion portion structure represented by (c20)

(c10)

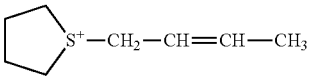

(c20)

$SbF_6^-$ (c-2): Onium salt containing a cation portion structure of a heterocyclic derivative having a straight chain hydrocarbon group represented by (c11) and an anion portion structure represented by (c21)

(c11)

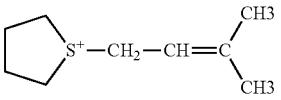

(c21)

$SbF_6^-$ (c-3): Trifluoromethanesulfonic acid copper (II) (d-1): Onium salt containing a cation portion structure represented by (d10) and an anion portion structure represented by (d20)

(d10)

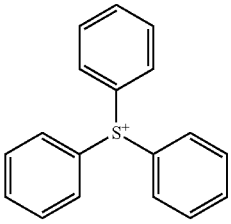

(d20)

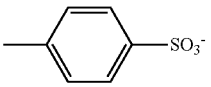

(d-2): Onium salt containing a cation portion structure represented by (d11) and an anion portion structure represented by (d21)

(d11)

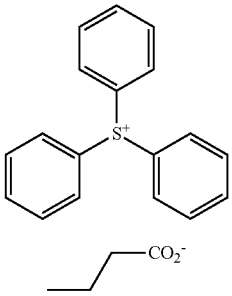

(d21)

(e-1): Propylene glycol monomethyl ether (f-1): SILQUEST A-187 SILANE (manufactured by Momentive Performance Materials Inc. Japan, LLC)

(g-1): EP-4000S (manufactured by ADEKA), Epoxy equivalent: 260, Viscosity: 1800 mPa·s/25° C.

(g-2): JER157S70 (manufactured by Japan epoxy resin), Epoxy equivalent: 210, Softening point: 70° C.

(g-3): EHPE3150 (manufactured by Daicel Corporation), Epoxy equivalent: 180, Softening point: 85° C.

(z-1): HIMAL1200 (Polyetheramide, manufactured by Hitachi Chemical Co., Ltd.), Solvent: N-methylpyrrolidone/Butyl cellosolve acetate (z-2): CELLOXIDE 2081 (manufactured by Daicel Corporation), The structural formula is shown below.

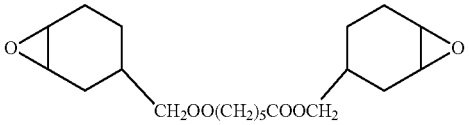

Manufacture of Liquid Discharge Head

Examples 1 to 22

First, as illustrated in FIG. 2A, a substrate 1 formed with silicon having energy-generating elements 2 containing TaSiN on the front surface side was prepared.

Next, as illustrated in FIG. 2B, SiCN was formed into a film with a thickness of 1.0 μm as an inorganic material layer 3 on the front surface side of the substrate 1 by a plasma CVD method in such a manner as to cover the energy-generating elements 2. Subsequently, Ta was formed into a film with a thickness of 0.25 μm as a protective layer 4 by a sputtering method. Furthermore, the inorganic material layer 3 and the protective layer 4 were patterned by a photolithography process and reactive ion etching.

Next, as illustrated in FIG. 2C, an intermediate layer 7 was formed on the upper portion of the inorganic material layer 3 in such a manner as to contact the inorganic material layer 3. As the intermediate layer 7, each composition shown in Table 1 was used. The intermediate layer 7 was formed by applying each composition with a spin coater, and then dried by prebaking the same under the conditions of 90° C. for 5 minutes in such a manner as to have a thickness of 2.0 μm.

Next, as illustrated in FIG. 2D, pattern exposure of the intermediate layer 7 was performed using an i-line exposure stepper (manufactured by CANON KABUSHIKI KAISHA, Trade name: i5), heated on a hot plate at 90° C. for 4 minutes, and further heated at 150° C. for 4 minutes. Then, as illustrated in FIG. 2E, the intermediate layer 7 was patterned by developing a non-exposed portion of the intermediate layer 7 with Methyl isobutyl ketone (MIBK).

Next, as illustrated in FIG. 2F, a mold material 8 was formed on the front surface side of the substrate 1. The mold material 8 was formed by applying polymethyl isopropenyl ketone (manufactured by TOKYO OHKA KOGYO CO., LTD., Trade name: ODUR-1010) with a thickness of 12 μm. Subsequently, the mold material 8 was patterned by a Deep-UV exposure device (manufactured by USHIO, INC., Trade name: UX3000).

Next, as illustrated in FIG. 2G, an organic material layer 9 was formed in such a manner as to cover the mold material 8. As the organic material layer 9, a negative photosensitive resin (manufactured by Nippon Kayaku Co., Ltd., Trade name: SU-8-3025) was applied onto the mold material 8 with a film thickness of 25 μm from the silicon substrate surface and 13 μm from the front surface of the mold material 8.

Subsequently, drying by prebaking was performed under the conditions of 90° C. for 5 minutes.

As illustrated in FIG. 2H, after the drying by prebaking, exposure of the organic material layer 9 was performed using a mask 10. The exposure was performed using an i-line exposure stepper (manufactured by CANON KABUSHIKI KAISHA, Trade name: i5), and further PEB was performed by a hot plate under the conditions of 90° C. for 4 minutes.

Next, as illustrated in FIG. 2I, a non-exposed portion of the organic material layer 9 was developed with Methyl isobutyl ketone (MIBK) to form discharge ports 12 in the organic material layer 9.

Next, a 1 mm wide etching mask having a rectangular opening shape was formed on the back surface of the substrate 1 with a polyetheramide resin composition (manufactured by Hitachi Chemical Co., Ltd., Trade name: HIMAL1200). Subsequently, the substrate 1 was immersed in 22% by mass of a TMAH (tetramethyl ammonium hydroxide) aqueous solution held at 80° C. for anisotropic etching (wet etching) of the substrate 1. Thus, as illustrated in FIG. 2J, a supply port 14 was formed in the substrate 1. When forming the supply port 14, the front surface side of the substrate 1 was covered with a protective film (manufactured by TOKYO OHKA KOGYO CO., LTD., Trade name: OBC) for the purpose of protecting the organic material layer 9 and the like on the front surface of the substrate 1 from the TMAH aqueous solution.

After the formation of the supply port 14, the protective film was dissolved and removed using xylene. Next, exposure of the entire surface of the substrate 1 was performed using a Deep-UV exposure device (manufactured by USHIO, INC., Trade name: UX-3000). Thereafter, by immersing the mold material 8 into methyl lactate while giving ultrasonic waves to dissolve and remove the mold material 8, a channel 15 was formed as illustrated in FIG. 2J.

Subsequently, the organic material layer 9 was cured by performing heat-treatment at 200° C. for 60 minutes, and then cut and separated from a wafer. Finally, bonding of members for liquid supply, electrical bonding for driving the energy-generating elements, and the like were performed. Thus, a liquid discharge head was manufactured.

Examples 23 to 25

Liquid discharge heads were manufactured in the same manner as in Examples 1 to 22, except forming SiN into a film with a thickness of 1.0 μm as the inorganic material layer 3 by a plasma CVD method. For the intermediate layer 7, each material shown in Table 1 was used.

Comparative Examples 1 to 4

Basically, Comparative Examples 1 to 4 were performed in the same manner as in Examples 1 to 25 above. For the intermediate layer 7, each material shown in Table 1 was used.

However, in Comparative Example 1, since a thermoplastic resin was used as the intermediate layer, only the patterning method for the intermediate layer of Comparative Example 1 was changed. Specifically, a polyether amide resin (manufactured by Hitachi Chemical Co., Ltd., Trade name: HIMAL1200) was formed into a film by spin coating, heated at 100° C. for 30 minutes, and further heated at 250° C. for 60 minutes. Thus, the applied solvent was evaporated to obtain a 2.0 μm thick intermediate layer. Next, a positive photosensitive resin (manufactured by TOKYO OHKA KOGYO CO., LTD., Trade name: OFPR800) was formed on the intermediate layer, and the positive photosensitive resin was patterned. Furthermore, the intermediate layer was patterned by $O_2$ plasma asking using the patterned positive photosensitive resin as a mask, and finally the positive photosensitive resin used as the mask was peeled. Thus, the intermediate layer of Comparative Example 1 was patterned.

Evaluation

Peeing Resistance

The peeling resistance between the inorganic material layer and the organic material layer was evaluated using the liquid discharge heads manufactured in Examples 1 to 25 and Comparative Examples 1 to 4.

The liquid discharge heads manufactured in Examples 1 to 25 and Comparative Examples 1 to 4 were based on a liquid discharge head of a printer PRO-1 manufactured by CANON KABUSHIKI KAISHA. A channel of each of these liquid discharge heads was charged with an ink shown in Table 2 shown below, and then allowed to stand for 14 days in a 80° C. oven.

TABLE 2

| Components | Part by mass |
|---|---|
| Diethylene glycol | 10.0 |
| 2-pyrolidone | 30.0 |
| 1,2-hexanediol | 5.0 |
| Acetylenol | 1.0 |
| Black pigment | 3.0 |
| Pure water | 51.0 |

The state of each of the inorganic material layer, the intermediate layer, and the organic material layer after allowed to stand was observed under a metallurgical microscope, and was evaluated according to the following criteria.

A; Even after storage at 80° C. for 14 days, peeling did not occur between each of the inorganic material layer, the intermediate layer, and the organic material layer.

B; After storage at 80° C. for 14 days, peeling at least partially occurred between each of the inorganic material layer, the intermediate layer, and the organic material layer.

(After storage at 80° C. for 7 days, peeling did not occur between each of the inorganic material layer, the intermediate layer, and the organic material layer.)

C; After storage at 80° C. for 7 days, peeling at least partially occurred between each of the inorganic material layer, the intermediate layer, and the organic material layer.

(After storage at 80° C. for 3 days, peeling did not occur between each of the inorganic material layer, the intermediate layer, and the organic material layer.)

D; After storage at 80° C. for 3 days, peeling at least partially occurred between each of the inorganic material layer, the intermediate layer, and the organic material layer.

The evaluation results are shown in Table 3.

Resolving Power

Figure 3:
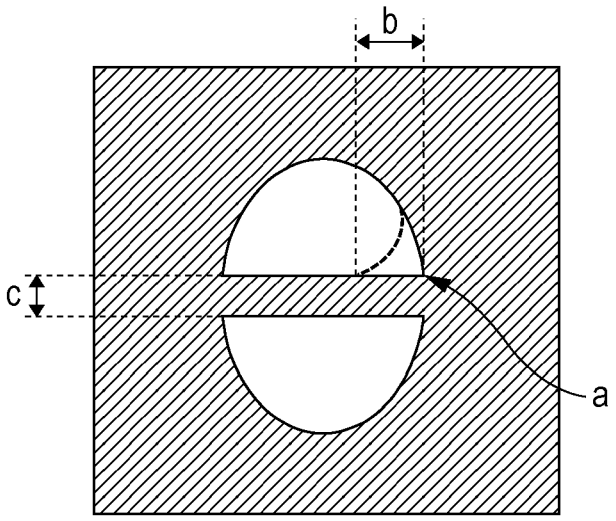
FIG. 3 is a view illustrating a mask for use in exposure.

Each composition shown in Table 1 was applied onto the substrate. Subsequently, exposure of each applied composition was performed using the mask illustrated in FIG. 3 to form a pattern. The exposure was performed using an i-line exposure stepper (manufactured by CANON KABUSHIKI KAISHA, Trade name: i5), and then, after the exposure, PEB was performed on a hot plate under the conditions of 90° C. for 4 minutes. Furthermore, each composition was patterned by developing a non-exposed portion with a developing solution. As the developing solution, Methyl isobutyl ketone (MIBK) was used. The mask illustrated in FIG. 3 is a model pattern in which a 3 μm (c of FIG. 3)-*wide* line pattern was bridged along the minor axis in an oval of Major axis of 20 μm×Minor axis of 16 μm.

Only in the composition of Comparative Example 1, the same pattern was formed by $O_2$ plasma asking using a positive photosensitive resin (manufactured by TOKYO OHKA KOGYO CO., LTD., Trade name: OFPR800) as a mask according to the above-described method.

Subsequently, a portion where the oval and the bridge pattern crossed each other was observed under a scanning electron microscope (SEM), and the resolving power was judged. When a virtual straight line along the edge of the bridge pattern was drawn from a semicircular end portion (a of FIG. 3) when the pattern was able to be formed following the mask pattern, the distance (b of FIG. 3) in which the virtual straight line and an actually resolved pattern crossed each other was defined as the resolving power (The unit is μm.). This means that when the actual pattern is resolved to the semicircular end portion (a of FIG. 3), the resolving power is 0 μm, which indicates that the pattern is in agreement with the design dimension. On the other hand, when the resolving power decreases, the composition remains in the semicircular end portion (a of FIG. 3). Therefore, the value of the resolving power can be determined according to the degree (b of FIG. 3) of the expansion of the composition.

The evaluation results are shown in Table 3. Since the resin itself of Comparative Example 1 does not have photosensitivity, the resolving power cannot be determined by this method, but it is clear that the resolving power is inferior to the compositions of Examples 1 to 25.

Storage Stability

The storage stability of each composition shown in Table 1 was evaluated. Using a composition after 1 hour passed after the preparation and a composition after 3 days passed at 25° C. after the preparation, each composition was applied onto the substrate. Subsequently, exposure was performed in such a manner that the design dimension when using the composition after 1 hour passed after the preparation was a 10 μm circular pattern to form a pattern. The exposure was performed using an i-line exposure stepper (manufactured by CANON KABUSHIKI KAISHA, Trade name: i5), and then, PEB was performed on a hot plate under the conditions of 90° C. for 4 minutes. The position of the focus in the exposure was set to the front surface of the pattern of the composition. Furthermore, each composition was patterned by developing a non-exposed portion with a developing solution. As the developing solution, Methyl isobutyl ketone (MIBK) was used.

The time after the preparation was calculated using the time when all the components shown in Table 1 were mixed as the starting point.

Only in the composition of Comparative Example 1, the same pattern was formed by $O_2$ plasma asking using a positive photosensitive resin (manufactured by TOKYO OHKA KOGYO CO., LTD., Trade name: OFPR800) as a mask according to the above-described method.

The area of the formed pattern was measured using a micromap MM5200 (manufactured by Ryoka Systems Inc.), and then the evaluation was performed according to the following criteria.

A: One having a difference in the area of the patterns between the composition after 1 hour passed after the preparation and the composition after 3 days passed at 25° C. after the preparation was 1% or less.

B: One having a difference in the area of the patterns between the composition after 1 hour passed after the preparation and the composition after 3 days passed at 25° C. after the preparation was larger than 1% and 3% or less.

C: One having a difference in the area of the patterns between the composition after 1 hour passed after the preparation and the composition after 3 days passed at 25° C. after the preparation was 3% or larger.

The evaluation results are shown in Table 3.

Applied Face State

The applied face state of each composition shown in Table 1 was evaluated. Each composition was applied onto a 8-inch Si substrate by spin coating, and then dried by prebaking under the conditions of 90° C. for 5 minutes to set the average film thickness to 2.0 μm. Using the substrate immediately after the application, the film thickness of a portion except a 3 mm periphery of the Si substrate was measured at 200 points, and then the evaluation was performed according to the following criteria.

A: One in which the film thickness at all the points was in the range of 2.0±0.2 μm.

B: One in which the film thickness at all the points was not in the range of 2.0±0.2 μm but in the range of 2.0±0.4 μm.

C: One in which the film thickness at all the points was not in the range of 2.0±0.4 μm.

The evaluation results are shown in Table 3.

TABLE 3

| | Examples | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| Peeling resistance | A | A | B | A | A | A | A | A | A | A | A | A | B | C | A |
| Resolving power | <0.5 | <0.5 | <0.5 | 0.8 | <0.5 | <0.5 | <0.5 | <0.5 | <0.5 | <0.5 | <0.5 | <0.5 | <0.5 | <0.5 | <0.5 |
| Storage stability | A | A | A | A | B | B | A | B | A | B | A | B | A | A | A |
| Applied face state | A | A | A | A | A | A | A | A | A | A | A | A | A | A | B |

| | Examples | | | | | | | | | | Comparative Examples | | | |
|---|---|---|---|---|---|---|---|---|---|---|---|---|---|---|
| | 16 | 17 | 18 | 19 | 20 | 21 | 22 | 23 | 24 | 25 | 1 | 2 | 3 | 4 |
| Peeling resistance | A | B | C | B | B | C | A | A | A | A | D | D | D | A |
| Resolving power | <0.5 | <0.5 | 0.5 | <0.5 | <0.5 | <0.5 | <0.5 | <0.5 | <0.5 | <0.5 | — | <0.5 | <0.5 | 1.1 |

TABLE 3-continued

| | | | | | | | | | | | | | | |
|---|---|---|---|---|---|---|---|---|---|---|---|---|---|---|
| Storage stability | A | A | B | B | A | A | B | A | A | A | A | A | A | C |
| Applied face state Peeling | C | A | A | A | A | A | A | A | A | A | A | A | A | A |

As shown in Table 3, it is found that the compositions of Examples 1 to 25 are good in terms of peeling resistance and resolving power. On the other hand, in the compositions of Comparative Examples 1 to 4, any one the peeling resistance, the resolving power, and the storage stability was low.

When Examples 1 and 2 are compared with Example 3, it is found that the resin having three or more cyclohexene oxide skeletons in the molecules of the present invention is desirably a resin having four or more cyclohexene oxide skeletons in the molecules in terms of peeling resistance.

When Example 1 is compared with Examples 5 and 6, it is found that the thermal cationic polymerization initiator of the present invention is desirably an onium salt containing the cation portion structure of the heterocyclic derivative represented by (c1) and the anion portion structure represented by (c2) in terms of storage stability.

When Example 1 is compared with Examples 13 and 14, it is found that the content of the resin having a cyclohexene oxide skeleton of the present invention in the composition is preferably 1% by mass or more and more preferably 3% by mass or more in terms of peeling resistance. It is also found that the content is preferably 70% by mass or less and more preferably 60% by mass or less in terms of applied face state.

When Example 1 is compared with Examples 17 to 19, it is found that the content of the photocationic polymerization initiator of the present invention in the composition is preferably 0.01% by mass or more and more preferably 0.05% by mass or more and preferably 20% by mass or less in terms of peeling resistance.

When Example 1 is compared with Examples 20 and 21, it is found that the content of the onium salt containing the cation portion structure represented by (d1) and the anion portion structure represented by (d2) of the present invention in the composition is preferably 6% by mass or less and more preferably 4% by mass or less in terms of peeling resistance.

When Example 1 is compared with Example 22, it is found that the anion portion structure of the onium salt containing the cation portion structure represented by (d1) and the anion portion structure represented by (d2) of the present invention is desirably the anion portion structure represented by (d20) in terms of storage stability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-211276 filed Oct. 8, 2013, which is hereby incorporated by reference herein in its entirety.

What is claimed is:

1. A liquid discharge head, comprising a substrate having an inorganic material layer, an organic material layer, and an intermediate layer contacting the inorganic material layer and the organic material layer between the inorganic material layer and the organic material layer, wherein the intermediate layer contains a resin having three or more cyclohexene oxide skeletons in molecules, a photocationic polymerization initiator, a thermal cationic polymerization initiator, and an onium salt containing a cation portion structure represented by (d1) shown below and an anion portion structure represented by (d2) shown below:

(d1)

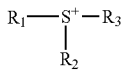

(d2)

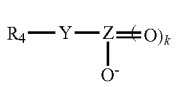

wherein, in the cation portion structure represented by (d1), $R_1$ to $R_3$ independently represent an organic group having 1 to 15 carbon atoms which may have a substituent, in the anion portion structure represented by (d2), Z represents a carbon atom or a sulfur atom, and when Z is a carbon atom, k=1 is established and when Z is a sulfur atom, k=2 is established, Y represents any one of —S(=O)$_2$—, an alkylene fluoride group having 1 to 15 carbon atoms, —O—CF$_2$—, —C(=O)—CF$_2$—, —O—C(=O)—CF$_2$—, —C(=O)—O—CF$_2$—, and a single bond, and $R_4$ represents a hydrocarbon group having 1 to 20 carbon atoms which may contain a hetero atom.

2. The liquid discharge head according to claim 1, wherein the resin having a cyclohexene oxide skeleton is a resin having four or more cyclohexene oxide skeletons in molecules.

3. The liquid discharge head according to claim 1, wherein the thermal cationic polymerization initiator is an onium salt containing a cation portion structure of a heterocyclic derivative represented by (c1) shown below and an anion portion structure represented by (c2) shown below:

(c1)

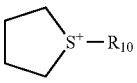

(c2)

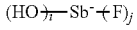

wherein, in the cation portion structure represented by (c1), $R_{10}$ represents a hydrocarbon group having 1 to 9 carbon atoms and, in the anion portion structure represented by (c1), i and j each represent an integer which satisfies i+j=6 and any one of i=0 to 6.

4. The liquid discharge head according to claim 1, wherein the thermal cationic polymerization initiator is an onium salt containing a cation portion structure of a heterocyclic derivative represented by (c1-1) shown below and an anion portion structure represented by (c2-1) shown below:

(c1-1)

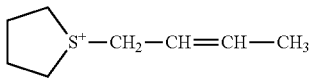

(c2-1)

$SbF_6^-$

5. The liquid discharge head according to claim 1, wherein the resin having three or more cyclohexene oxide skeletons in molecules is a resin represented by (a1) shown below:

(a1)

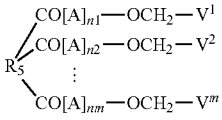

wherein, in (a1), $R_5$ represents a hydrocarbon group having 1 to 30 carbon atoms which may contain an alicyclic epoxy group, [A]s each represent any one of —O—, —C(=O)—, and an alkyl group having 1 to 9 carbon atoms which may also contain a branched chain, [A]s may be the same or different from each other, Vs each represent a group represented by (a2) shown below and are bonded to (a1) through * in (a2) shown below, Vs may be the same or different from each other, m represents an integer of 2 or more, a coefficient (n1-nm) of [A] represents 0 or an integer of 1 or more, and when m is 2, the resin has one or more cyclohexene oxide skeletons in $R_5$, (a2)

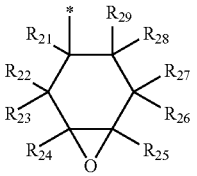

wherein $R_{22}$ to $R_{29}$ independently represent a hydrogen atom or an alkyl group having 1 to 9 carbon atoms.

6. The liquid discharge head according to claim 1, wherein the inorganic material layer is formed with at least one of silicon oxide, silicon carbide, and silicon carbonitride.

7. The liquid discharge head according to claim 1, wherein the anion portion structure represented by (d2) is an anion portion structure represented by (d20) shown below:

(d20)

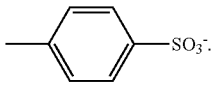

8. The liquid discharge head according to claim 1, wherein a content of the resin having a cyclohexene oxide skeleton in the intermediate layer is 1% by mass or more.

9. The liquid discharge head according to claim 1, wherein the content of the resin having a cyclohexene oxide skeleton in the intermediate layer is 3% by mass or more.

10. The liquid discharge head according to claim 1, wherein the content of the resin having a cyclohexene oxide skeleton in the intermediate layer is 70% by mass or less.

11. The liquid discharge head according to claim 1, wherein the content of the resin having a cyclohexene oxide skeleton in the intermediate layer is 60% by mass or less.

12. The liquid discharge head according to claim 1, wherein a content of the photocationic polymerization initiator in the intermediate layer is 0.01% by mass or more.

13. The liquid discharge head according to claim 1, wherein the content of the photocationic polymerization initiator in the intermediate layer is 0.05% by mass or more.

14. The liquid discharge head according to claim 1, wherein the content of the photocationic polymerization initiator in the intermediate layer is 20% by mass or less.

15. The liquid discharge head according to claim 1, wherein a content of the onium salt containing the cation portion structure represented by (d1) and the anion portion structure represented by (d2) in the intermediate layer is 6% by mass or less.

16. The liquid discharge head according to claim 1, wherein the content of the onium salt containing the cation portion structure represented by (d1) and the anion portion structure represented by (d2) in the intermediate layer is 4% by mass or less.

* * * * *